US010138699B2

(12) United States Patent
Nguyen

(10) Patent No.: US 10,138,699 B2
(45) Date of Patent: Nov. 27, 2018

(54) HANGER LOCK SYSTEM

(71) Applicant: Cameron International Corporation, Houston, TX (US)

(72) Inventor: Dennis P. Nguyen, Pearland, TX (US)

(73) Assignee: Cameron International Corporation, Houston, TX (US)

( * ) Notice: Subject to any disclaimer, the term of this patent is extended or adjusted under 35 U.S.C. 154(b) by 539 days.

(21) Appl. No.: 14/587,952

(22) Filed: Dec. 31, 2014

(65) Prior Publication Data

US 2016/0186523 A1 Jun. 30, 2016

(51) Int. Cl.
*E21B 33/04* (2006.01)
*E21B 19/06* (2006.01)

(52) U.S. Cl.
CPC ..... *E21B 33/0415* (2013.01); *E21B 19/06* (2013.01); *E21B 33/04* (2013.01); *E21B 33/0422* (2013.01)

(58) Field of Classification Search
CPC .. E21B 33/0415; E21B 33/04; E21B 33/0422; E21B 19/06
USPC ..... 166/382
See application file for complete search history.

(56) References Cited

U.S. PATENT DOCUMENTS 3,924,679 A * 12/1975 Jansen, Jr. ..... E21B 33/043 166/182
3,999,604 A * 12/1976 Amancharla ..... E21B 23/02 166/206
4,416,472 A * 11/1983 Fowler ..... E21B 33/043 166/217
4,674,576 A * 6/1987 Goris ..... E21B 23/06 166/125
4,941,691 A * 7/1990 Reimert ..... E21B 33/038 285/315
2010/0193195 A1* 8/2010 Nguyen ..... E21B 33/04 166/338
2010/0276156 A1* 11/2010 Jennings ..... E21B 33/04 166/379
2011/0005774 A1 1/2011 Sinnott et al.

FOREIGN PATENT DOCUMENTS

| | | | |
|---|---|---|---|
| SG | 191674 | A1 | 7/2013 |
| WO | 2009/014795 | A2 | 1/2009 |
| WO | 2010/080294 | A2 | 7/2010 |
| WO | 2010/088037 | A2 | 8/2010 |
| WO | 2011/057416 | A1 | 5/2011 |
| WO | 2014/093318 | A2 | 6/2014 |

OTHER PUBLICATIONS

PCT International Search Report and Written Opinion; Application No. PCT/US2015/065114; dated Mar. 11, 2016; 13 pages.

* cited by examiner

*Primary Examiner* — Nicole Coy
*Assistant Examiner* — Dany E Akakpo
(74) *Attorney, Agent, or Firm* — Fletcher Yoder, P.C.

(57) ABSTRACT

A system including a hanger lock system, including a positive lock system, including a load ring configured to engage a first tubular, and a lock ring configured to energize the load ring, a tool including a first piston configured to couple to a second tubular, a second piston configured to couple to the lock ring to energize the load ring.

20 Claims, 8 Drawing Sheets

102
118
104
120
140
142
38
32
76
60
76
36
72
74
78
76
150
130
62
110
134
80
83
81
82
132
34
106
84
86
112
108
108
112
128
22
122

HANGER LOCK SYSTEM

BACKGROUND

This section is intended to introduce the reader to various aspects of art that may be related to various aspects of the present invention, which are described and/or claimed below. This discussion is believed to be helpful in providing the reader with background information to facilitate a better understanding of the various aspects of the present invention. Accordingly, it should be understood that these statements are to be read in this light, and not as admissions of prior art.

In some drilling and production systems, hangers, such as a tubing hanger, may be used to suspend strings of tubing for various flows in and out of a well. Such hangers may be disposed within a wellhead that supports both the hanger and the string. For example, a tubing hanger may be lowered into a wellhead and supported therein. To facilitate the running or lowering process, the tubing hanger may couple to a tubing hanger running tool (THRT). Once the tubing hanger has been lowered into a landed position within the wellhead by the THRT, the tubing hanger may then be locked into position. The THRT may then be disconnected from the tubing hanger and extracted from the wellhead. Unfortunately, wellheads components (e.g., spools) with preformed ledges or landings reduce the size of the bore, which requires either smaller drilling equipment or larger more expensive wellheads with larger bores.

BRIEF DESCRIPTION OF THE DRAWINGS

Various features, aspects, and advantages of the present invention will become better understood when the following detailed description is read with reference to the accompanying figures in which like characters represent like parts throughout the figures, wherein.

DETAILED DESCRIPTION OF SPECIFIC EMBODIMENTS

One or more specific embodiments of the present invention will be described below. These described embodiments are only exemplary of the present invention. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

The disclosed embodiments include a hanger lock system that enables use of wellhead components without a preformed hanger landing. Accordingly, the component may be smaller while still providing a bore size that accommodates standard drilling equipment. The hanger lock system includes a positive lock system and a tool (e.g., a retrievable running tool). In operation, the tool couples to the hanger and lowers the hanger and positive lock system into position within the wellhead. Once in position, the tool activates the positive lock system to couple the hanger to the wellhead. As will be explained in detail below, the tool includes a running block and a torque sleeve. In operation, the running block enables the tool to couple to, lower, and release from the hanger, while the torque sleeve enables the tool to energize the positive lock system. Specifically, the torque sleeve energizes the positive lock system by coupling to and axially driving a lock ring into contact with a load ring. The contact between the load ring and the lock ring forces the load ring radially outward and into a groove in the casing. In some embodiments, the lock or load ring may include protrusions that increase pressurized contact between the lock ring and the load ring to resist axial movement of the lock ring once the load ring is set. In this manner, the hanger lock system enables complete use of the casing bore during drilling operations.

Figure 1:
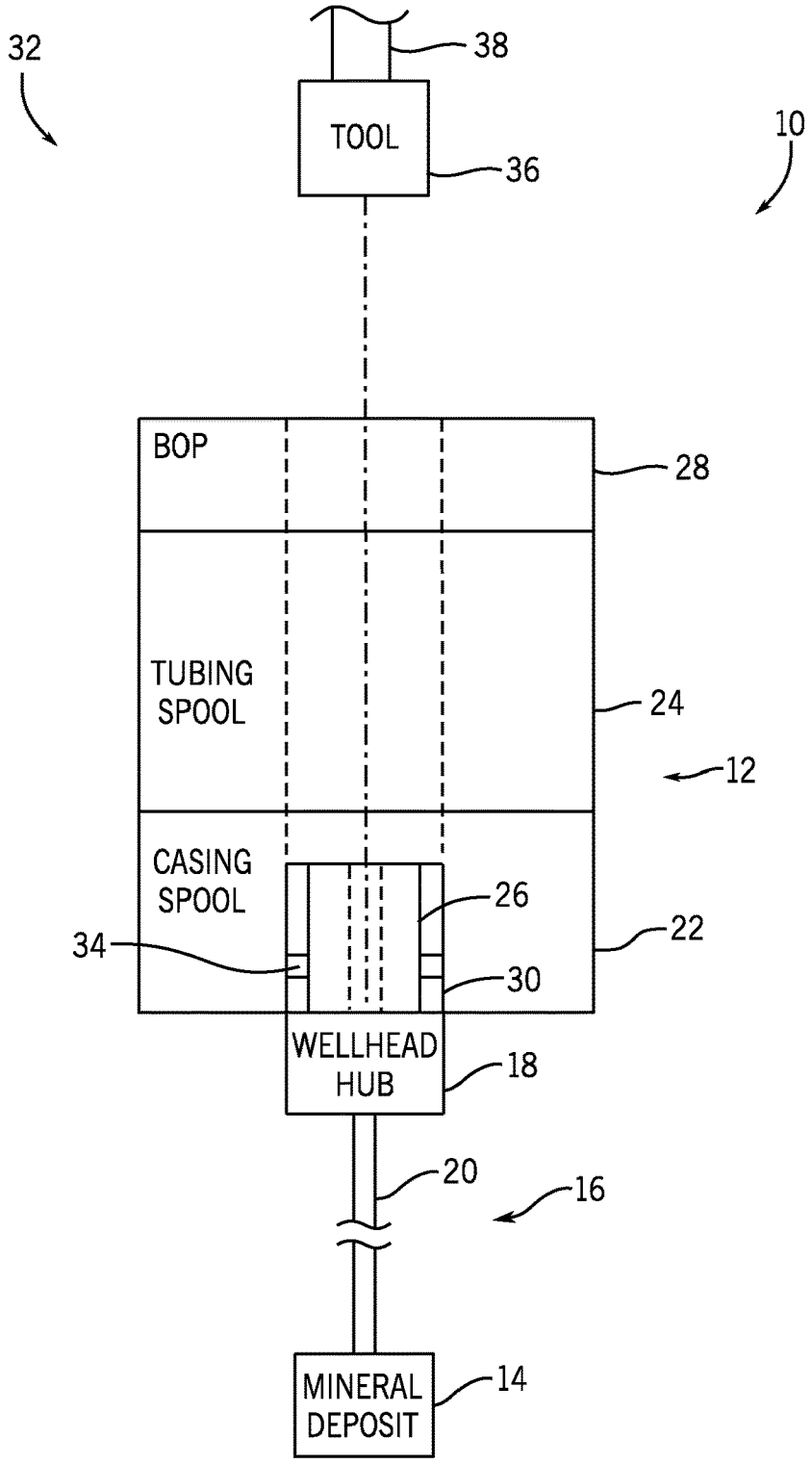
FIG. 1 is a block diagram of an embodiment of a mineral extraction system.

FIG. 1 is a block diagram that illustrates a mineral extraction system 10 (e.g., hydrocarbon extraction system) that can extract various minerals and natural resources, including hydrocarbons (e.g., oil and/or natural gas) from the earth. The mineral extraction system 10 may be land-based (e.g., a surface system) or subsea (e.g., a subsea system). The system 10 includes a wellhead 12 coupled to a mineral deposit 14 via a well 16, wherein the well 16 includes a wellhead hub 18 and a well-bore 20. The wellhead hub 18 includes a large diameter hub at the end of the well-bore 20 that enables the wellhead 12 to couple to the well 16. The wellhead 12 includes multiple components that control and regulate activities and conditions associated with the well 16. For example, the wellhead 12 includes a casing spool 22 (e.g., tubular), a tubing spool 24 (e.g., tubular), a hanger 26 (e.g., a tubing hanger or a casing hanger), and a blowout preventer (BOP) 28 and a "Christmas" tree (not shown).

In operation, wellhead 12 enables completion and workover procedures, such as tool insertion (e.g., the hanger 26) into the well 16 and the injection of various chemicals into the well 16. Further, minerals extracted from the well 16 (e.g., oil and natural gas) may be regulated and routed via the wellhead 12. For example, the blowout preventer (BOP) 28 or "Christmas" tree may include a variety of valves, fittings, and controls to prevent oil, gas, or other fluid from exiting the well 16 in the event of an unintentional release of pressure or an overpressure condition.

As illustrated, the casing spool 22 defines a bore 30 that enables fluid communication between the wellhead 12 and the well 16. Thus, the casing spool bore 30 may provide access to the well bore 20 for various completion and workover procedures. To emplace the hanger 26 within the casing spool 22, the hydrocarbon extraction system 10 includes a hanger lock system 32. The hanger lock system 32 includes a positive lock system 34 and a tool 36 (e.g., a retrievable running tool). After drilling, the hanger lock system 32 may lower the tubing hanger 26 and the positive lock system 34 into the well with a drill string 38. Once inside the casing spool bore 30, the tool 36 secures the hanger 26 to casing spool 22 by energizing the positive lock system 34. The ability to couple the hanger 26 to the casing spool 22 after drilling operations maximizes use of the casing spool bore 30 for drilling operations (e.g., enables larger drilling equipment), while still enabling the tubing hanger 26 to couple to the casing spool 22 after drilling operations.

Figure 2:
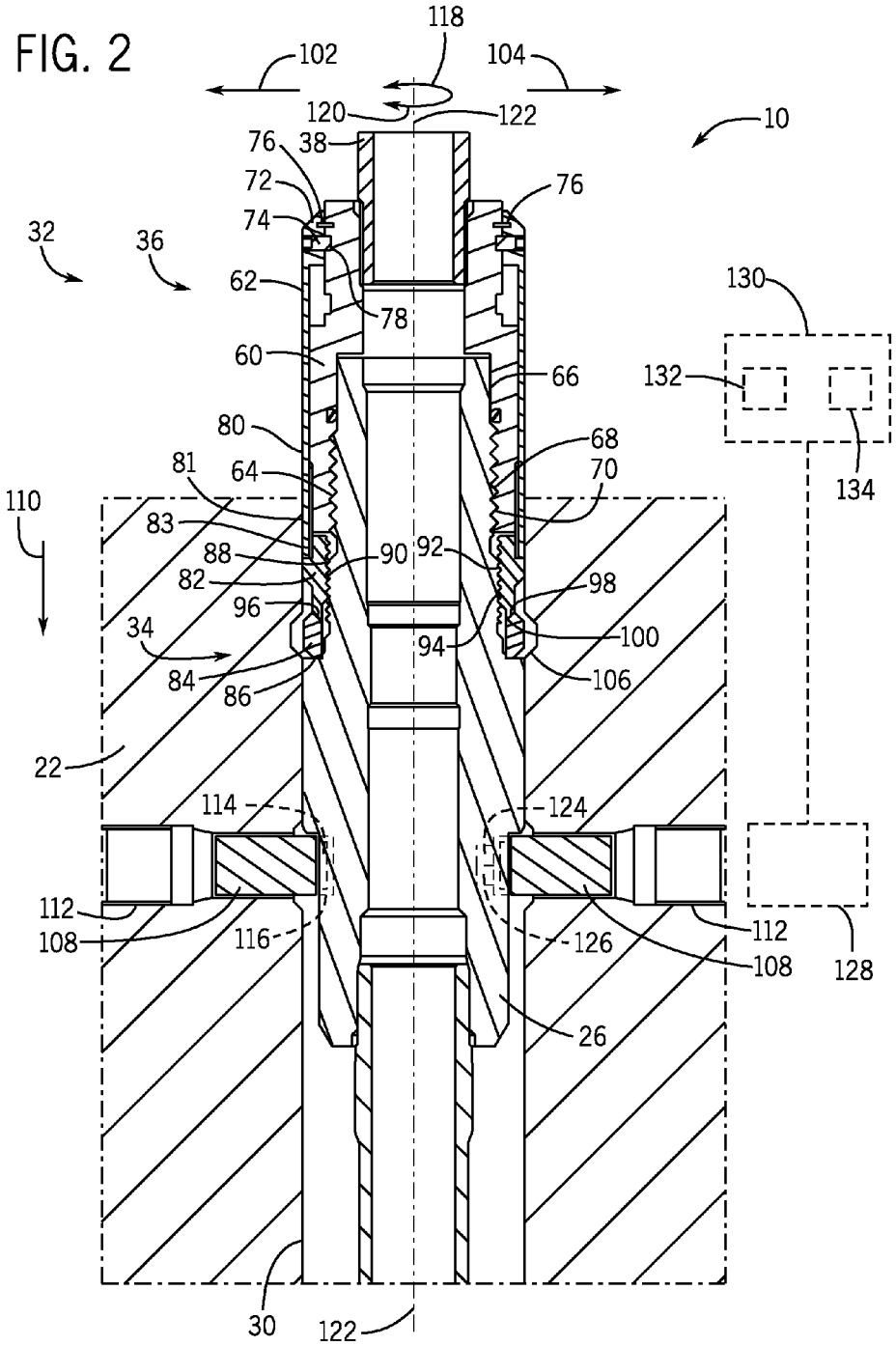
FIG. 2 is a cross-sectional view of an embodiment of a hanger lock system with a positive lock system in an unenergized state.

FIG. 2 is a cross-sectional view of an embodiment of a hanger lock system 32 with the positive lock system 34 in an unenergized state. As explained above, the hanger lock system 32 includes the positive lock system 34 and the tool 36. In operation, the hanger lock system 32 uses the tool 36 to couple to the hanger 26 as well as energize the positive lock system 34. The tool 36 includes a running block 60 (e.g., annular piston) and a torque sleeve 62 (e.g., annular piston). As illustrated, the running block 60 includes threads 64 on an interior surface 66 to couple to corresponding threads 68 on an exterior surface 70 (e.g., annular surface) of the tubing hanger 26. The threads 64 and 68 enable the running block 60 to threadingly connect and disconnect from the tubing hanger 26. Surrounding the running block 60 is the torque sleeve 62. The torque sleeve 62 enables the tool 36 to couple to and energize the positive lock system 34. As illustrated, the torque sleeve 62 couples to the running block 60 at a first axial end 72 with one or more pins 74 (e.g., 1, 2, 3, 4, 5, or more) and one or more shear pins 76 (e.g., 1, 2, 3, 4, 5, or more). As will be explained in detail below, the pins 74 rest within an annular groove 78 that enables the pins 74 to rotate about the running block 60 once the shear pins 76 have been sheared. At a second end 80, the torque sleeve 62 includes fingers 81 that couple to the positive lock system 34. For example, the fingers 81 may rest within axial grooves 83 of a lock ring 82. In some embodiments, the fingers 81 may couple to the lock ring 82 with shear pins.

The positive lock system 34 includes the lock ring 82 and a load ring 84 (e.g., C-ring) surrounding the hanger 26. As illustrated, the hanger 26 supports the load ring 84 on a landing 86 (e.g., circumferential landing), while the lock ring 82 threadingly couples to the hanger 26. The lock ring 82 includes threads 88 on an interior surface 90 (e.g., annular surface) that engage corresponding threads 92 on an exterior surface 94 (e.g., annular surface) of the hanger 26. As will be explained in detail below, the threads 88 on the lock ring 82 and the threads 92 on the hanger 26 may be oppositely oriented from the threads 64 on the running block 60 and threads 68 on the hanger 26 (e.g., left-handed threads versus right-threads). The different thread orientations (e.g., left-handed threads versus right-threads) enable the tool 32 to simultaneously unthread from the hanger 26 while energizing the positive lock system 34. In an unenergized state, the lock ring 82 and load ring 84 form an angled interface 96 (e.g., tapered annular or conical interface) with angled surfaces 98 and 100 (e.g., tapered annular or conical surfaces). The angled interface 96 enables the lock ring 82 to slide past the load ring 84, and drive the load ring 84 radially outward in directions 102, 104 and into the groove 106 (e.g., annular groove) as the positive lock system energizes.

In order to align the load ring 84 with the groove 106, the hanger lock system 32 may include one or more bars 108 that block axial movement of the hanger 26 in direction 110. As illustrated, the bars 108 may be inserted into apertures 112 (e.g., radial apertures) in the casing spool 22, enabling the bars 108 to extend into the bore 30 and into contact with a ledge 114 (e.g., axial facing annular ledge) on the hanger 26. In some embodiments, the bars 108 may rest within grooves 116 (e.g., radial pockets, axial grooves, circumferential groove, etc.) on the hanger 26 to block axial movement in direction 110 as well as rotation in directions 118 (e.g., counter-clockwise) or direction 120 (e.g., clockwise) about the axis 122. In another embodiment, the hanger lock system 32 may align the load ring 84 with the groove 106 using a light emitting device 124 (e.g., laser) coupled to a power source 126 (e.g., a battery). As the tubing hanger 26 is lowered into the wellhead 12, the light emitting device 124 (e.g., laser unit) emits light (e.g., laser beam) that passes through the aperture 112 in the casing spool 22. The light may be continuously or periodically emitted from the light emitting device 124, enabling a sensor 128 to detect the light once the hanger 26 reaches the aperture 112. Once the sensor 128 detects light from the light emitting device 124 through the aperture 112, the mineral extraction system 10 may stop movement of the setting tool 36 in axial direction 62, thus aligning the load ring 84 with the recess 106. In some embodiments, a controller 130 may control movement of the setting tool 36 in response to the detection of light by the sensor 128. For example, the controller 130 may couple to the sensor 128 and to the mineral extraction system 10. As the sensor 128 detects light from the light emitting device 124, a processor 132 in the controller 130 may execute instructions stored by the memory 134 to stop movement of the drill string 38. In some embodiments, the device 124 may be a proximity sensor, contact sensor, non-contact sensor, optical sensor, capacitive sensor, clearance sensor, wireless device, magnetic sensor, etc. that facilitates alignment of the load ring 84 with the recess 106. In another embodiment, the exact distance from the surface to the recess 106 may be known, enabling the setting tool 36 to be lowered to a proper position within the wellhead 12 without the controller 130 and the sensor 128.

Figure 3:
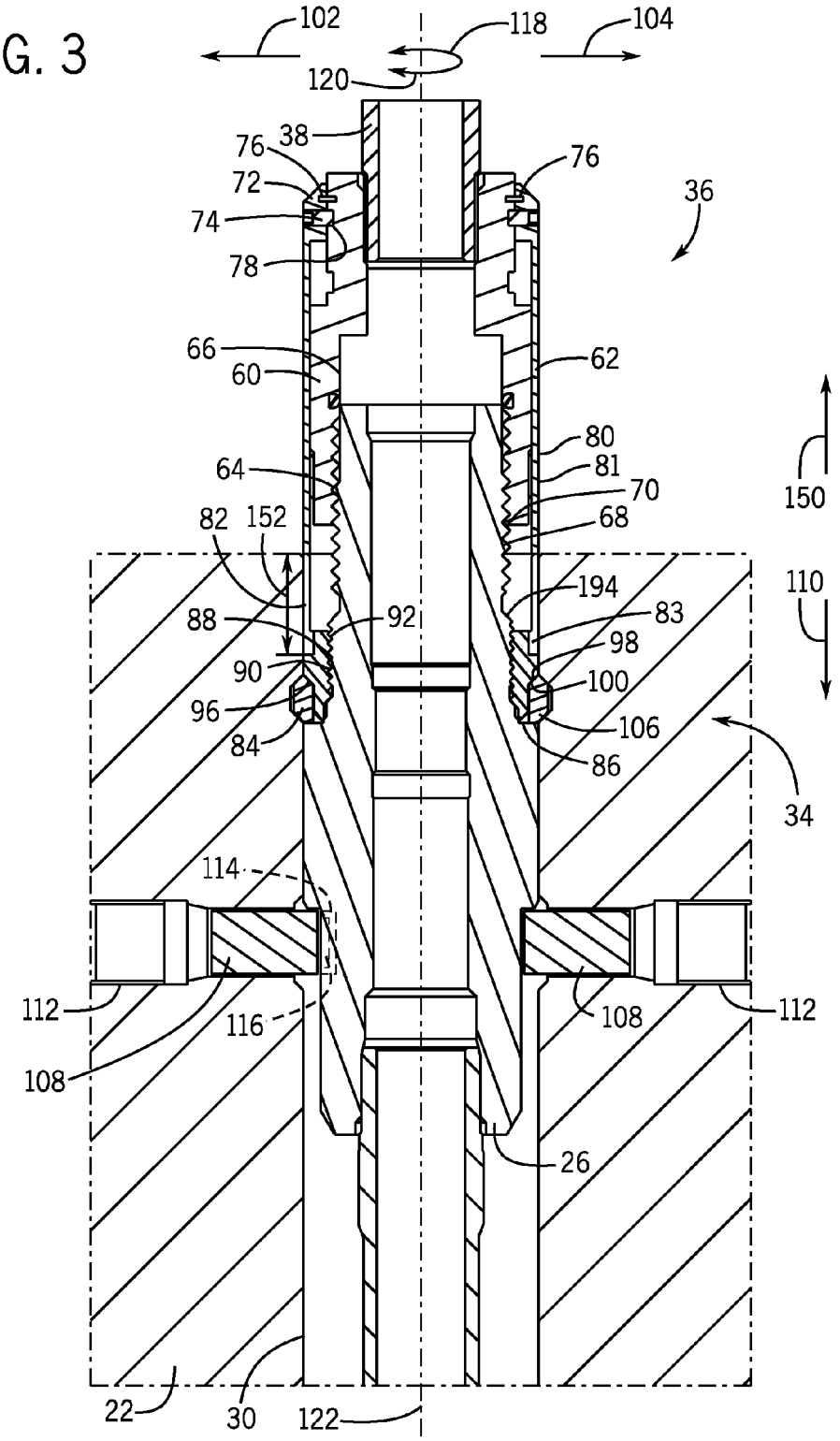
FIG. 3 is a cross-sectional view of an embodiment of a hanger lock system with a positive lock system in an energized state.

FIG. 3 is a cross-sectional view of an embodiment of the hanger lock system 32 with the positive lock system 34 in an energized state. In order to energize the positive lock system 34 and uncouple the tool 36 from the hanger 26, the drill string 38 rotates the tool 36 in either direction 118 or 120. The direction of rotation depends on the orientation of the threads 68 on the running hanger 26 (e.g., left-handed threads, right-handed threads). As the running block 60 rotates, the running block 60 unthreads from the hanger 26, moves in axial direction 150, and uncouples from the hanger 26. Furthermore, as the running block 60 rotates, the running block 60 rotates the torque sleeve 62 in the same direction. However, instead of uncoupling the lock ring 82 from the hanger 26, the torque sleeve 62 drives the lock ring 82 in direction 110. As explained above, the threads 64 and 68 are oppositely oriented from the threads 88 and 92. For example, the threads 64 on the running block 60 and threads 68 on the hanger 26 may be right-handed threads while the threads 88 on the lock ring 82 and threads 92 on the hanger 26 may be left-handed threads, or vice versa. Accordingly, as the running block 60 rotates and unthreads from the hanger 26 in axial direction 150, the rotation of the torque sleeve 62 with the running block 60 drives the lock ring 82 in axial direction 110. To accommodate the movement of the torque sleeve 62 and lock ring 82 in opposite directions, the axial grooves 83 in the lock ring 82 extend a distance 152 enabling the fingers 83 to maintain contact with the torque sleeve 62. As the lock ring 82 moves in axial direction 110, the lock ring 82 and load ring 84 contact one another at the angled interface 86 (e.g., curved annular interface or conical interface). The continuous movement of the lock ring 82 in direction 110 forces the angled surfaces 98 and 100 to slide past one another driving the load ring 84 radially outward in directions 102 and 104 and into the recess 106 on the casing spool 22. As the torque sleeve 62 continues to rotate, the torque sleeve 62 drives the lock ring 82 radially inside of the load ring 84 until the lock ring 82 contacts the ledge 86 (e.g., annular ledge). When the lock ring 82 contacts the ledge 86, the ledge 86 blocks further rotation and axial movement of the lock ring 82. As the torque sleeve 62 continues to rotate with the running block 60, the torque sleeve 62 shears through the shear pins 76. After shearing through the shear pins 76, the torque sleeve 62 is able to remain stationary while the running block 60 finishes unthreading from the hanger 26.

Figure 4:
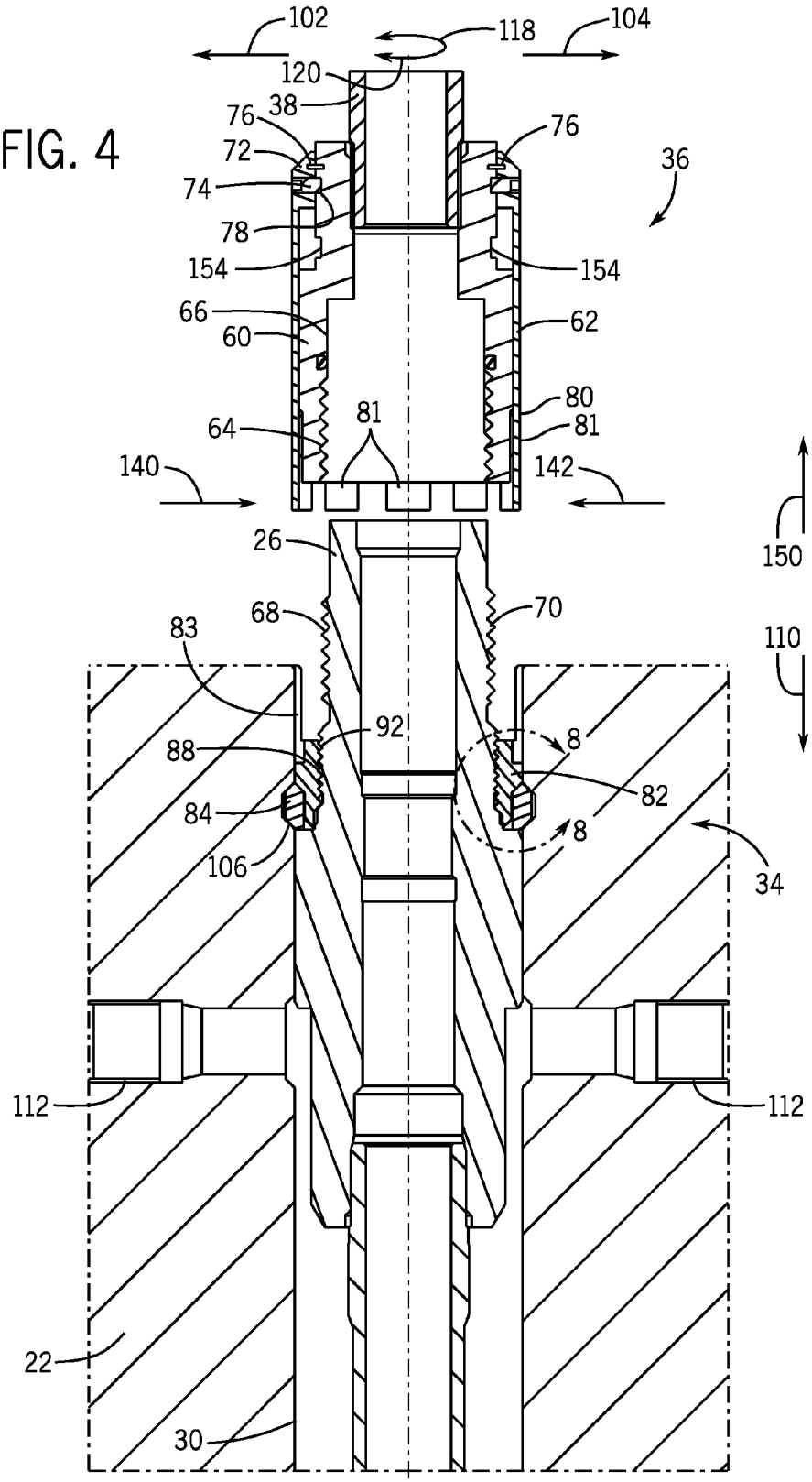
FIG. 4 is a cross-sectional view of an embodiment of a positive lock system in an energized state.

FIG. 4 is a cross-sectional view of an embodiment of the positive lock system 34 in an energized state. In the energized state, the load ring 84 rests within the groove 106 with the lock ring 82 radially within the load ring 84. In this position, the lock ring 82 blocks radial movement (e.g., retraction) of the load ring 84 in directions 140 and 142 enabling the load ring 84 to support the hanger 26 within the casing 22. As explained above, once the positive lock system 34 is energized, further rotation of the torque sleeve 62 enables the torque sleeve 62 to shear through the shear pins 76. After shearing through the shear pins 76, the tool 36 is withdrawn using the drill string 38 and the bars 108 may be removed using a remotely controlled vehicle (ROV).

In some embodiments, the tool 36 may also facilitate removal of the hanger 26. For example, the running block 60 may include one or more apertures 154. The apertures 154 enable the torque sleeve 62 to couple to the running block 60 with pins 74 (e.g., threaded fasteners) at a lower axial position in direction 110 than the groove 78. When the torque sleeve 62 couples to the one or more apertures 78, the fingers 81 on the torque sleeve 62 are able to enter the groove 83 on the lock ring 82, when the positive lock system 34 is energized. Accordingly, as the running block 60 threads onto the hanger 26 in axial direction 110 the torque sleeve 62 unthreads the lock ring 82 in axial direction 150. As the lock ring 82 moves in axial direction 150 the load ring 84 is able to radially retract in radial directions 140 and 142 from the recess 106 uncoupling the hanger 26 from the spool 22.

Figure 5:
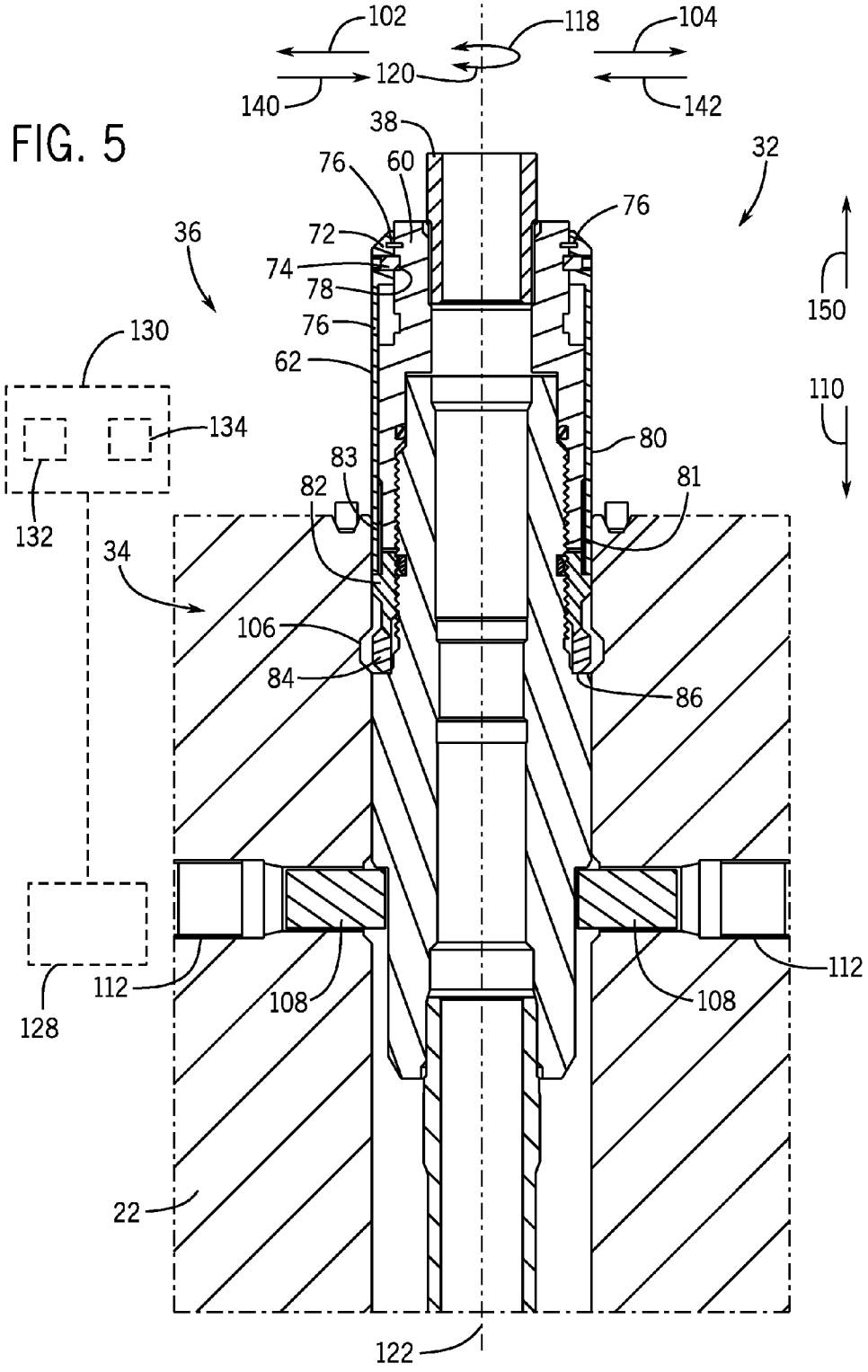
FIG. 5 is a cross-sectional view of an embodiment of a hanger lock system with a positive lock system in an unenergized state.

FIG. 5 is a cross-sectional view of an embodiment of a hanger lock system 32 with a positive lock system 34 in an unenergized state. However, instead of oppositely oriented threads, all of the threads in the hanger lock system 32 of FIG. 5 have the same orientation. As explained above, the hanger lock system 32 enables insertion and coupling of the hanger 26 to the casing spool 22. As illustrated, the tool 36 uses the running block 60 to couple to the hanger 26, and the torque sleeve 62 to couple to the positive lock system 34. The running block 60 couples to the tubing hanger 26 using threads 64 on an interior surface 66 that engage corresponding threads 68 on an exterior surface 70 of the tubing hanger 26. In operation, the threads 64 and 68 enable the running block 60 to threadingly connect and disconnect from the tubing hanger 26. Surrounding the running block 60 is the torque sleeve 62. The torque sleeve 62 couples to the running block 60 at a first axial end 72 with one or more pins 74 that rest within a groove 78, and with one or more shear pins 76 (e.g., 1, 2, 3, 4, 5, or more). In operation, the tool 36 lowers the hanger 26 with the positive lock system 34 into the casing spool 22. In order to align the load ring 84 with the groove 106, the hanger lock system 32 may include one or more bars 108 that block axial movement of the hanger 26 in direction 110. As illustrated, the bars 108 may be inserted into apertures 112 in the casing spool 22 (e.g., inserted with a remotely operated vehicle), enabling the bars 108 to extend into the bore 30 and into contact with a ledge 114 on the hanger 26. In some embodiments, the bars 108 may rest within grooves 116 on the hanger 26 to block axial movement in direction 110 as well as rotation in directions 118 (e.g., counter-clockwise) or direction 120 (e.g., clockwise) about the axis 122. As explained above, certain embodiments may use the light emitting device 124 (e.g., laser) coupled to the power source 126 (e.g., a battery). As the tubing hanger 26 is lowered into the wellhead 12, the light emitting device 124 (e.g., laser unit) emits light (e.g., laser beam) that passes through the aperture 112 in the casing spool 22. The light may be continuously or periodically emitted from the light emitting device 124, enabling the sensor 128 to detect the light once the hanger 26 reaches an aperture 112. Once the sensor 128 detects light from the light emitting device 124, through the aperture 112, the mineral extraction system 10 may stop movement of the setting tool 36 in axial direction 62, thus aligning the load ring 84 with the recess 106. For example, the controller 130 may control movement of the setting tool 36 in response to light detection by the sensor 128. In some embodiments, the device 124 may be a proximity sensor, contact sensor, non-contact sensor, optical sensor, capacitive sensor, clearance sensor, wireless device, magnetic sensor, etc. that facilitates alignment of the load ring 84 with the recess 106. In another embodiment, the exact distance from the surface to the recess 106 may be known, enabling the setting tool 36 to be lowered to a proper position within the wellhead 12 without the controller 130 and the sensor 128.

Figure 6:
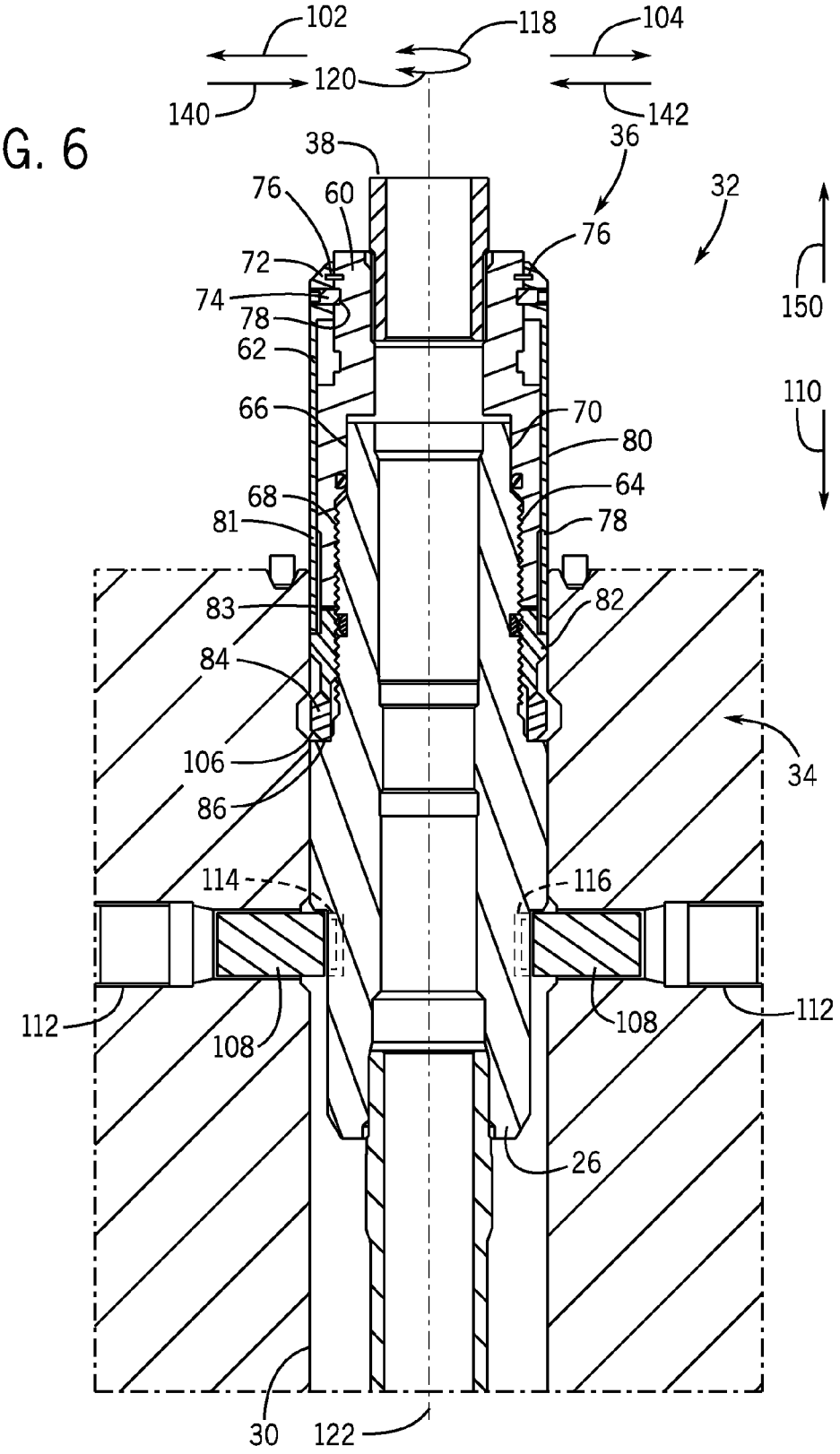
FIG. 6 is a cross-sectional view of an embodiment of a hanger lock system with a positive lock system in an energized state.

FIG. 6 is a cross-sectional side view of an embodiment of a hanger lock system 32 with a positive lock system 34 in an energized state. In order to energize the positive lock system 34, the drill string 38 rotates the tool 36 in either direction 118 or 120. The direction of rotation depends on the orientation of the threads 68 and 92 on the hanger 26 (e.g., left-handed threads, right-handed threads). In other words in some embodiments the threads 68 and 92 may have the same orientation. Accordingly, the running block 60 and lock ring 82 rotate in the same direction driving the lock ring 82 axially toward the ledge 86 in axial direction 110, with the torque sleeve 62. As the lock ring 82 moves in axial direction 110, the lock ring 82 and load ring 84 contact one another at the angled interface 86 (e.g., curved annular interface or conical interface). The progressive movement of the lock ring in direction 110 then forces the angled surfaces 98 and 100 to slide past one another, driving the load ring 84 radially outward in directions 102 and 104 and into the recess 106 on the casing spool 22. As the torque sleeve 62 continues to rotate, the torque sleeve 62 drives the lock ring 82 radially inside of the load ring 84 until the lock ring 82 contacts the ledge 86 (e.g., annular ledge). When the lock ring 82 contacts the ledge 86, the ledge 86 blocks further rotation and axial movement of the lock ring 82. As the torque sleeve 62 continues to rotate with the running block 60, the torque sleeve 62 is able to shear through the shear pins 76. Once the torque sleeve 62 shears through the shear pins 76, the torque sleeve 62 is able to remain stationary as the pins 74 slide within the annular groove 78.

Figure 7:
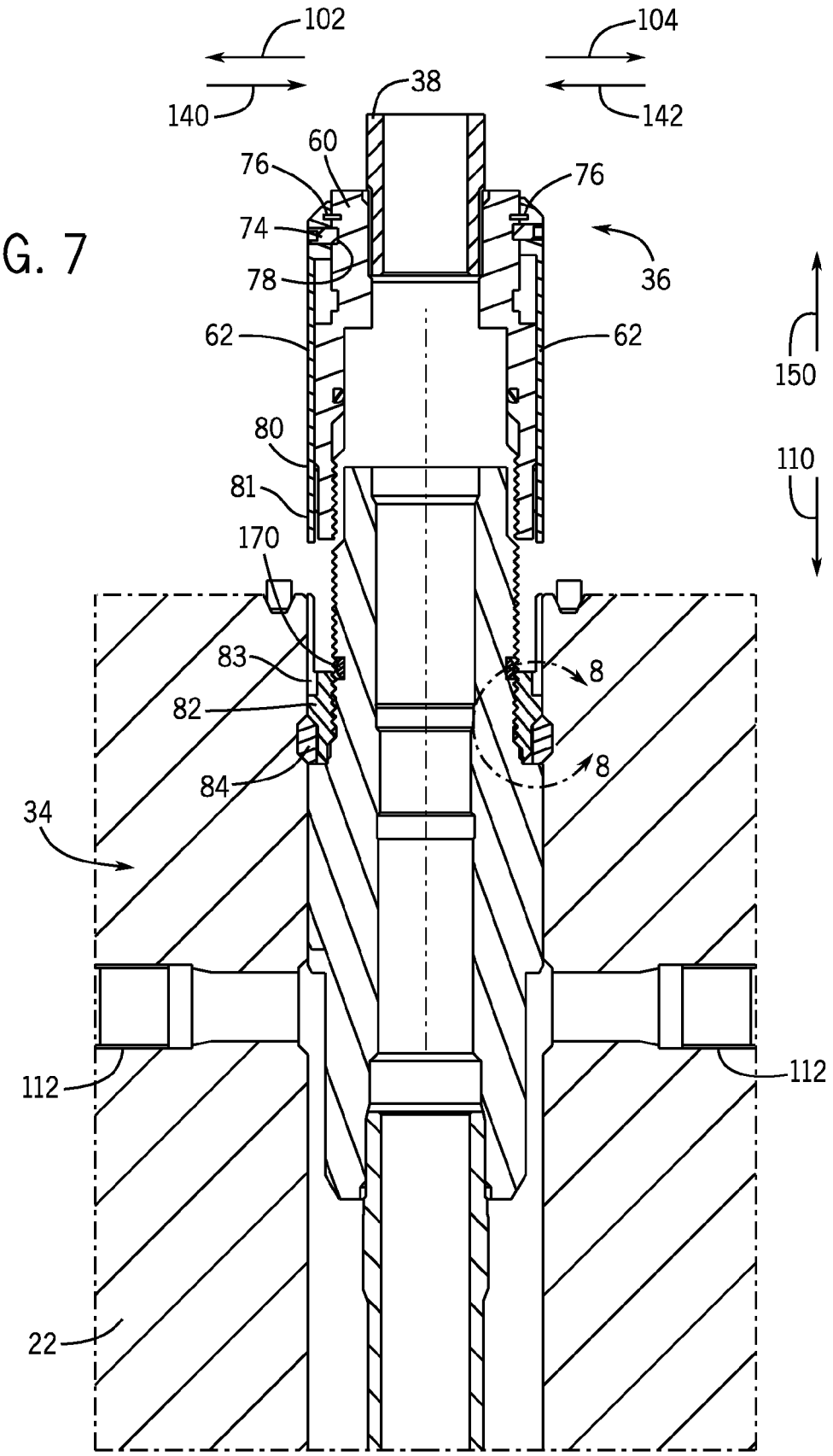
FIG. 7 is a cross-sectional view of an embodiment of a positive lock system in an energized state.

FIG. 7 is a cross-sectional side view of an embodiment of a positive lock system 34 in an energized state. In the energized state, the load ring 84 rests within the groove 106 with the lock ring 82 radially within the load ring 84. In this position, the lock ring 82 blocks retraction of the load ring 84 in radial directions 140 and 142 out of the recess 106 enabling the load ring 84 to support the hanger 26 within the casing 22. As explained above, when the load ring 84 is secured within the groove 106, the running tool 38 may start rotating in the opposite direction (e.g., direction 118 or 120) to unthread the tool 36 from the hanger 26. After uncoupling the tool 36, the drill string 38 withdraws the tool 36. In some embodiments, as the drill string 38 withdraws the tool 36, the tool 36 uncovers a retaining ring or retaining pins 170 that extend radially in directions 102 and 104 to block axial movement of the lock ring 82 in direction 150.

Figure 8:
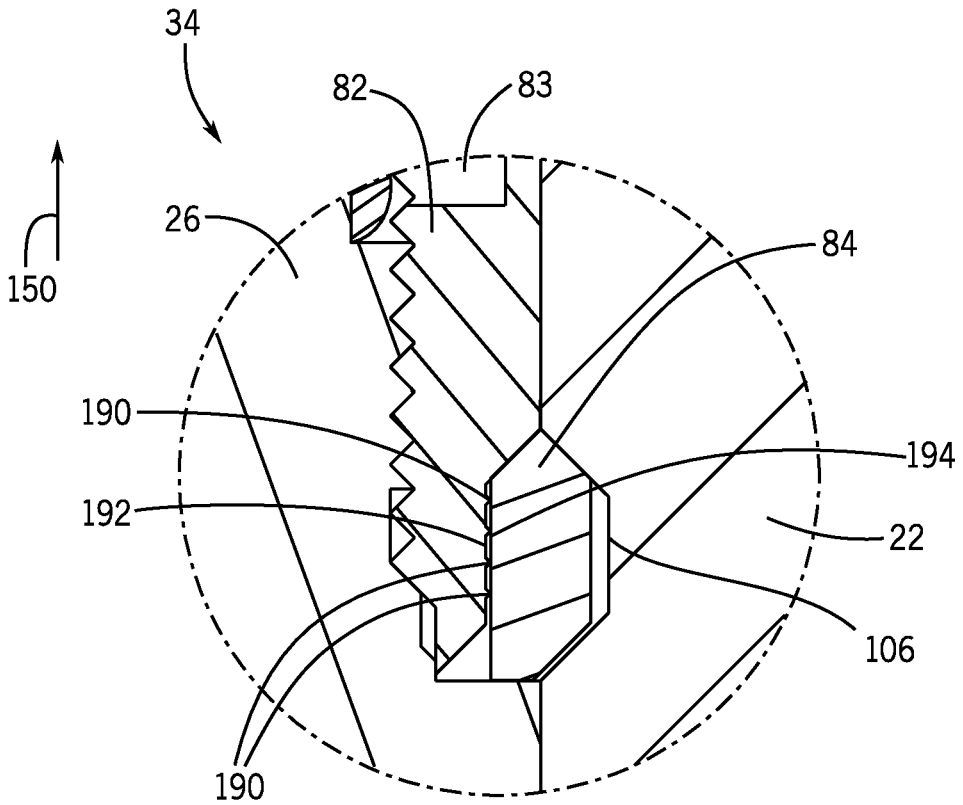
FIG. 8 is a sectional view of an embodiment of a positive lock system in an energized state within line 8-8 of FIG. 7.

FIG. 8 is a detail view within line 8-8 of FIGS. 4 and 7 of an embodiment of the positive lock system 34 in a locked or energized position. As illustrated, the load ring 84 is forced circumferentially into the groove 106 by the lock ring 82. In some embodiments, the lock ring 82 may include protrusions 190 on an exterior surface 192. In other embodiments, the load ring 84 may include the protrusions 190 on an interior surface 194. These protrusions 190 may increase pressurized contact between the lock ring 82 and the load ring 84, which resists axial movement of the lock ring 82 in direction 150, thus blocking the load ring 84 from retracting from the recess 106.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. A system, comprising:

a hanger lock system, comprising:

a positive lock system, comprising:

a load ring configured to engage a first tubular; and a lock ring configured to energize the load ring, wherein the lock ring comprises first threads configured to interface with first mating threads of a second tubular along a first threaded interface;

a tool, comprising:

a first piston having second threads configured to interface with second mating threads of the second tubular along a second threaded interface, wherein the tool is configured to rotate the first piston to couple and uncouple the tool with the second tubular via the second threaded interface; and a second piston configured to couple to the lock ring with at least one torque transfer interface to energize the load ring, wherein the at least one torque transfer interface comprises an axial protrusion that interfaces with an axial groove over an axial path of movement between the second piston and the lock ring, the tool is configured to rotate the second piston to drive rotation of the lock ring along the first threaded interface to cause axial movement of the lock ring that causes radial movement of the load ring between an unenergized position and an energized position relative to the first tubular, and the second piston couples to the first piston with one or more shear structures configured to shear in response to torque after the load ring is driven from the unenergized position to the energized position.

2. The system of claim 1, wherein the second piston is disposed about the first piston.

3. The system of claim 1, wherein the first and second threads are oppositely oriented.

4. The system of claim 3, wherein the tool is configured to rotate the first piston along the second threaded interface to unthread the first piston from the second tubular while rotating the second piston to rotate the lock ring along the first threaded interface to drive the load ring from the unenergized position to the energized position relative to the first tubular.

5. The system of claim 4, wherein the first and second pistons are configured to rotate together and move axially together while driving the load ring from the unenergized position to the energized position relative to the first tubular.

6. The system of claim 1, wherein the tool is configured to move the second piston axially away from the lock ring over the axial path of movement while the tool causes the axial movement of the lock ring that causes the radial movement of the load ring between the unenergized position and the energized position.

7. The system of claim 1, wherein the first and second threads have the same orientation.

8. The system of claim 7, wherein the tool is configured to rotate in a first rotational direction until the one or more shear structures shear in response to the torque, and the tool is configured to rotate in an opposite second rotational direction after shearing the one or more shear structures to disengage the tool.

9. The system of claim 1, wherein the lock ring comprises a tapered annular surface and a cylindrical surface, the tapered annular surface is configured to wedgingly drive the load ring from the unenergized position to the energized position, and the cylindrical surface is configured to overlap and hold the load ring in the energized position after being energized by the tapered annular surface.

10. The system of claim 1, wherein the at least one torque transfer interface comprises a plurality of torque transfer interfaces spaced circumferentially about a central axis, and each of the plurality of torque transfer interfaces has the axial protrusion that interfaces with the axial groove over the axial path of movement between the second piston and the lock ring.

11. The system of claim 1, wherein the axial protrusion comprises an axial finger disposed on the second piston, and the axial groove is disposed on the lock ring.

12. The system of claim 1, comprising at least one of the first tubular or the second tubular, wherein at least one of the first tubular is a casing spool or the second tubular is a hanger.

13. The system of claim 1, wherein the first and second pistons are coupled together by a rotatable coupling having one or more structures disposed in an annular groove, the rotatable coupling is configured to block axial movement between the first and second pistons, and the rotatable coupling is configured to allow rotational movement between the first and second pistons.

14. A system, comprising:

a tool, comprising:

a first piston having first threads configured to interface with first mating threads along a first threaded interface; and a second piston configured to couple to a lock ring with at least one torque transfer interface to energize a load ring against a first tubular, wherein the at least one torque transfer interface comprises an axial protrusion that interfaces with an axial groove over an axial path of movement between the second piston and the lock ring, the tool is configured to rotate the second piston to drive rotation of the lock ring along a second threaded interface to cause axial movement of the lock ring that causes radial movement of the load ring between an unenergized position and an energized position relative to the first tubular, and the second piston couples to the first piston with one or more shear structures configured to shear in response to torque after the load ring is driven from the unenergized position to the energized position.

15. The system of claim 14, wherein the first and second threads are oppositely oriented, and the tool is configured to move the second piston axially away from the lock ring over the axial path of movement while the tool causes the axial movement of the lock ring that causes the radial movement of the load ring between the unenergized position and the energized position.

16. A method, comprising:

rotating a tool having first and second pistons;

driving a lock ring to move along a first threaded interface via rotation of the second piston of the tool and torque transfer via at least one torque transfer interface between the second piston and the lock ring, wherein the at least one torque transfer interface comprises an axial protrusion that interfaces with an axial groove over an axial path of movement between the second piston and the lock ring while driving the lock ring;

driving the first piston to move along a second threaded interface of a second tubular disposed in a first tubular via rotation of the first piston of the tool;

energizing a load ring with the lock ring via movement of the lock ring along the first threaded interface, wherein energizing comprises driving radial movement of the load ring from an unenergized position to an energized position; and shearing through one or more shear structures between the first and second pistons by continuing to rotate the tool after energizing the load ring with the lock ring.

17. The method of claim 16, wherein the at least one torque transfer interface comprises a plurality of torque transfer interfaces spaced circumferentially about a central axis, and each of the plurality of torque transfer interfaces has the axial protrusion that interfaces with the axial groove over the axial path of movement between the second piston and the lock ring.

18. The method of claim 16, comprising moving the second piston axially away from the lock ring over the axial path of movement while energizing the load ring with the lock ring.

19. The method of claim 16, wherein driving the first piston comprises unthreading the first piston from the second tubular via the rotation of the first piston of the tool.

20. The method of claim 19, wherein the first and second threaded interfaces have oppositely oriented threads, wherein rotating the tool causes rotation of the first and second pistons in a common direction to cause the unthreading of the first piston while energizing the load ring with the lock ring via movement of the lock ring along the first threaded interface.

* * * * *